US005268113A

United States Patent [19]

Evans

[11] Patent Number: 5,268,113

[45] Date of Patent: Dec. 7, 1993

[54] LUBRICANT COMPOSITION

[75] Inventor: Samuel Evans, Marly, Switzerland

[73] Assignee: Ciba-Geigy Corporation, Ardsley, N.Y.

[21] Appl. No.: 933,599

[22] Filed: Aug. 20, 1992

Related U.S. Application Data

[63] Continuation of Ser. No. 546,277, Jun. 28, 1990, abandoned.

[30] Foreign Application Priority Data

Jul. 7, 1989 [CH] Switzerland ..... 2528/89

[51] Int. Cl.[5] ..... C10M 133/40

[52] U.S. Cl. ..... 252/47.005; 252/51.005R; 252/401; 252/404

[58] Field of Search ..... 252/48.6, 50, 515R, 252/401, 404, 47.5

[56] References Cited

U.S. PATENT DOCUMENTS

| | | | |
|---|---|---|---|
| 4,069,199 | 1/1978 | Ramey et al. . | |
| 4,699,939 | 10/1987 | Orban | 252/48.6 |
| 4,759,862 | 7/1988 | Meier | 252/48.6 |
| 4,780,492 | 10/1988 | Avar | 252/401 |
| 4,888,369 | 12/1989 | Moore | 252/401 |
| 4,954,275 | 9/1990 | Rosenberger | 252/48.6 |

FOREIGN PATENT DOCUMENTS

| | | |
|---|---|---|
| 0356677 | 3/1990 | European Pat. Off. . |
| 60-28496 | 2/1985 | Japan . |

OTHER PUBLICATIONS

Ullmann's Encyclopedia 20, 541-543 (1981).

*Primary Examiner*—Jacqueline V. Howard
*Attorney, Agent, or Firm*—Luther A. R. Hall

[57] ABSTRACT

Lubricants can be stabilized against oxidation by the addition of a) a sterically hindered amine and b) a phenol of formula I

I wherein A, is hydrogen, alkyl, cycloalkyl, phenylalkyl, phenyl or alkylthiomethyl, B is alkyl, cycloalkyl, phenylalkyl, phenyl or alkylthiomethyl and X is hydrogen, alkyl or substituted alkyl. It is preferred to use phenols of formula I which contain a thioether group.

10 Claims, No Drawings

LUBRICANT COMPOSITION

This is a continuation of application Ser. No. 07/546,277, filed on Jun. 28, 1990, now abandoned.

The present invention relates to lubricant compositions which are stabilized against oxidative degradation. Stabilization is effected by the incorporation of at least two specific additives.

It is known and conventional to incorporate additives into lubricants based on mineral oils or synthetic oils in order to improve their general use properties. Additives for stabilizing lubricants against oxidative degradation, known as antioxidants, are especially important. The oxidative degradation of lubricants is particularly significant in the case of engine oils, because high temperatures prevail in the combustion chamber of engines and, as well as oxygen, nitrogen oxides ($NO_x$) are present and act as oxidation catalysts.

The antioxidants used for lubricants are, in particular, organic sulfur and phosphorus compounds and also aromatic amines and phenols, especially sterically hindered phenols (see e.g. Ullmanns Encyklopädie der technischen Chemie (Ullmann's Encyclopaedia of Chemical Technology), 4th edition, Verlag Chemie, volume 20 (1981), page 541-43).

Sterically hindered amines have also already been proposed as stabilizers for lubricating oils, e.g. in U.S. Pat. No. 4,069,199 or JP-A-85/28496.

EP-A-356 677 has proposed mixtures of aromatic amines and sterically hindered amines as antioxidants for lubricants, it also being possible for phenolic antioxidants to be added to these mixtures.

It has been found that combinations of phenolic antioxidants with sterically hindered amines are outstandingly suitable for the stabilization of lubricants, even without the addition of aromatic amines.

The present invention relates to a lubricant composition comprising (A) a mineral or synthetic oil or a mixture of such oils, (B) at least one sterically hindered amine and (C) at least one phenol of formula I

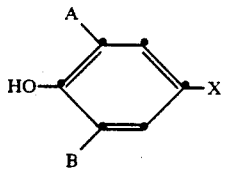

I wherein A is hydrogen, $C_1$-$C_{24}$ alkyl, $C_5$-$C_{12}$ cycloalkyl, $C_7$-$C_9$ phenylalkyl, phenyl or a group $—CH_2—S—R^1$ or

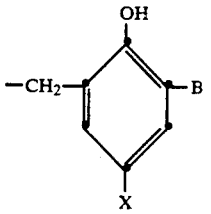

B is $C_1$-$C_{24}$ alkyl, $C_5$-$C_{12}$ cycloalkyl, $C_7$-$C_9$ phenylalkyl, phenyl or a group $—CH_2—S—R^1$, X is hydrogen, $C_1$-$C_{18}$ alkyl or one of the groups $—C_aH_{2a}—S_q—R^2$, $—C_bH_{2b}—CO—OR^3$, $—C_bH_{2b}—CO—N(R^5)(R^6)$, $—CH_2N(R^{10})(R^{11})$ and

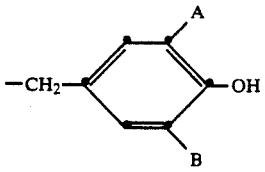

$R^1$ is $C_1$-$C_{18}$ alkyl, phenyl or a group $—(CH_2)_c—CO—OR^4$ or $—CH_2CH_2OR^9$, $R^2$ is hydrogen, $C_1$-$C_{18}$ alkyl, phenyl, benzyl or a group

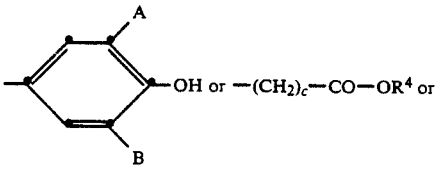

$—CH_2CH_2OR^9$, $R^3$ is $C_1$-$C_{50}$ alkyl or one of the groups

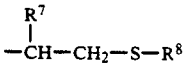

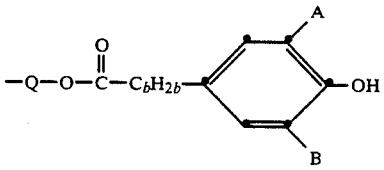

and

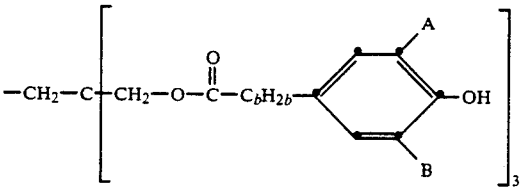

wherein Q is $C_2$-$C_8$ alkylene, $C_4$-$C_6$ thiaalkylene or a group $—CH_2CH_2(OCH_2CH_2)_d—$, $R^4$ is $C_1$-$C_{24}$ alkyl, $R^5$ is hydrogen, $C_1$-$C_{18}$ alkyl or cyclohexyl, $R^6$ is $C_1$-$C_{18}$ alkyl, cyclohexyl, phenyl, $C_1$-$C_{18}$ alkyl-substituted phenyl or one of the groups

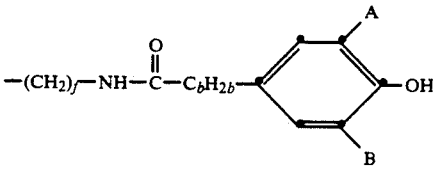

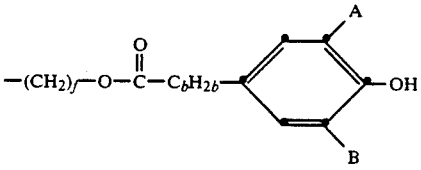

-continued

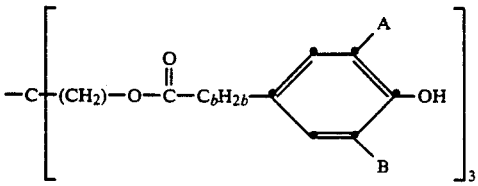

or $R^5$ and $R^6$ together are $C_4$-$C_8$ alkylene which can be interrupted by —O— or —NH—, $R^7$ is hydrogen, $C_1$-$C_4$ alkyl or phenyl, $R^8$ is $C_1$-$C_{18}$ alkyl, $R^9$ is hydrogen, $C_1$-$C_{24}$ alkyl, phenyl, $C_2$-$C_{18}$ alkanoyl or benzoyl, $R^{10}$ is $C_1$-$C_{18}$ alkyl, cyclohexyl, phenyl, $C_1$-$C_{18}$ alkyl-substituted phenyl or a group

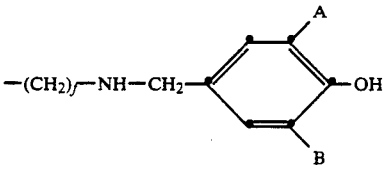

$R^{11}$ is hydrogen, $C_1$-$C_{18}$ alkyl, cyclohexyl or a group

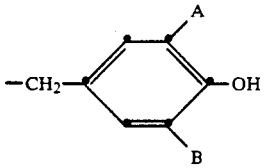

or $R^{10}$ and $R^{11}$ together are $C_4$-$C_8$ alkylene which can be interrupted by —O— or —NH—, a is 0, 1, 2 or 3, b is 0, 1, 2 or 3, c is 1 or 2, d is 1 to 5, f is 2 to 8 and q is 1, 2, 3 or 4, or, as component (C), a mixture of polyphenols formed by reacting at least one phenol of the formula

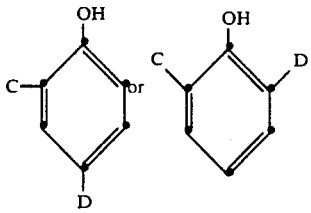

with at least one phenol of the formula

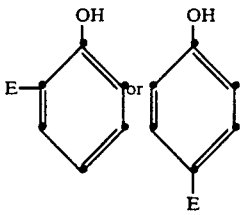

and with formaldehyde or paraformaldehyde, wherein C, D and E independently of the others are $C_1$-$C_{24}$ alkyl, cyclohexyl or phenyl, the composition containing no aromatic amine.

In this composition, the weight ratio of (B) to (C) is preferably 1:1 to 1:100, especially 1:3 to 1:20. The sum of (B) and (C) is preferably 0.05 to 5% by weight, especially 0.1 to 3% by weight, of (A).

A and B as $C_1$-$C_{24}$ alkyl can be linear or branched alkyl, e.g. methyl, ethyl, i-propyl, t-butyl, s-butyl, s-pentyl, t-pentyl, n-hexyl, i-hexyl, t-hexyl, i-heptyl, n-octyl, t-octyl, s-decyl, s-dodecyl, n-dodecyl, s-tetradecyl, n-hexadecyl, n-octadecyl, s-octadecyl or n-eicosyl.

A and B as cycloalkyl can be e.g. cyclopentyl, cyclohexyl or cyclooctyl, especially cyclohexyl. A and B as phenylalkyl can be e.g. benzyl, phenylethyl, phenylpropyl or $\alpha,\alpha$-dimethylbenzyl.

$R^5$ and $R^6$ alkyl can be e.g. methyl, ethyl, propyl, butyl, pentyl, hexyl, octyl, decyl or dodecyl. $R^1$, $R^2$, $R^3$ and $R^8$ as $C_1$-$C_{18}$ alkyl can also be e.g. tetradecyl, hexadecyl or octadecyl. $R^4$ as $C_1$-$C_{24}$ alkyl can also be e.g. eicosyl or tetraeicosyl.

The subscript a is preferably 0, 1 or 2, especially 0 or 1; b is preferably 0, 1 or 2, especially 1 or 2; q is preferably 1 or 2, especially 1.

Component (A) is a mineral or synthetic base oil of the kind conventionally used for the preparation of lubricants. Synthetic oils can be e.g. esters of polycarboxylic acids or of polyols, aliphatic polyesters or poly-$\alpha$-olefins, silicones, phosphoric acid esters or polyalkylene glycols. The lubricant can also be a grease based on an oil and a thickener. Such lubricants are described e.g. in D. Klamann "Schmierstoffe und artverwandte Produkte" ("Lubricants and Generically Related Products"), Verlag Chemie, Weinheim 1982.

Component (B) can be any cyclic or non-cyclic, preferably cyclic, sterically hindered amine. (B) is preferably a compound containing at least one group of formula II

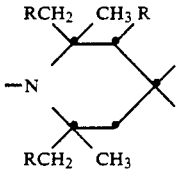

II wherein R is hydrogen or methyl. R is preferably hydrogen. Said compounds are derivatives of polyalkylpiperidines, especially of 2,2,6,6-tetramethylpiperidine. These compounds preferably carry one or two polar substituents or a polar spiro ring system in the 4-position of the piperidine ring. They can be low-molecular, oligomeric or polymeric compounds.

The following classes of polyalkylpiperidines are of particular importance:

a) Compounds of formula III

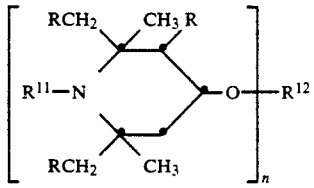

III wherein n is a number from 1 to 4, preferably 1 or 2, R is hydrogen or methyl, $R^{11}$ is hydrogen, oxyl, hydroxyl, $C_1$-$C_{12}$ alkyl, $C_3$-$C_8$ alkenyl, $C_3$-$C_8$ alkynyl, $C_7$-$C_{12}$ aralkyl, $C_1$-$C_{18}$ alkoxy, $C_5$-$C_8$ cycloalkoxy, $C_7$-$C_9$ phenylalkoxy, $C_1$-$C_8$ alkanoyl, $C_3$-$C_5$ alkenoyl, $C_1$-$C_{18}$ alkanoyloxy, benzyloxy, glycidyl or a group —$CH_2$C-

H(OH)—Z, wherein Z is hydrogen, methyl or phenyl, $R^{11}$ preferably being H, $C_1$–$C_4$ alkyl, allyl, benzyl, acetyl or acryloyl, and $R^{12}$ when n is 1 is hydrogen, $C_1$–$C_{18}$ alkyl which may be interrupted by one or more oxygen atoms, cyanoethyl, benzyl, glycidyl, a monovalent radical of an aliphatic, cycloaliphatic, araliphatic, unsaturated or aromatic carboxylic acid, carbamic acid or phosphorus-containing acid, or a monovalent silyl radical, preferably a radical of an aliphatic carboxylic acid having 2 to 18 C atoms, of a cycloaliphatic carboxylic acid having 7 to 15 C atoms, of an $\alpha,\beta$-unsaturated carboxylic acid having 3 to 5 C atoms or of an aromatic carboxylic acid having 7 to 15 C atoms, $R^{12}$ when n is 2 is $C_1$–$C_{12}$ alkylene, $C_4$–$C_{12}$ alkenylene, xylylene, a divalent radical of an aliphatic, cycloaliphatic, araliphatic or aromatic dicarboxylic acid, dicarbamic acid or phosphorus-containing acid, or a divalent silyl radical, preferably a radical of an aliphatic dicarboxylic acid having 2 to 36 C atoms, of a cycloaliphatic or aromatic dicarboxylic acid having 8–14 C atoms or of an aliphatic, cycloaliphatic or aromatic dicarbamic acid having 8–14 C atoms, $R^{12}$ when n is 3 is a trivalent radical of an aliphatic, cycloaliphatic or aromatic tricarboxylic acid, of an aromatic tricarbamic acid or of a phosphorus-containing acid, or a trivalent silyl radical, and $R^{12}$ when n is 4 is a tetravalent radical of an aliphatic, cycloaliphatic or aromatic tetracarboxylic acid.

Any $C_1$–$C_{12}$ alkyl substituents are e.g. methyl, ethyl, n-propyl, n-butyl, sec-butyl, tert-butyl, n-hexyl, n-octyl, 2-ethylhexyl, n-nonyl, n-decyl, n-undecyl or n-dodecyl.

$R^{11}$ or $R^{12}$ as $C_1$–$C_{18}$ alkyl can be e.g. the groups listed above and additionally n-tridecyl, n-tetradecyl, n-hexadecyl or n-octadecyl, for example.

$R^{11}$ as $C_3$–$C_8$ alkenyl can be e.g. prop-1-enyl, allyl, methallyl, but-2-enyl, pent-2-enyl, hex-2-enyl, oct-2-enyl or 4-tert-butylbut-2-enyl.

$R^{11}$ as $C_3$–$C_8$ alkynyl is preferably propargyl.

$R^{11}$ as $C_7$–$C_{12}$ aralkyl is especially phenethyl and in particular benzyl.

$R^{11}$ as $C_1$–$C_8$ alkanoyl is, for example, formyl, propionyl, butyryl or octanoyl, but preferably acetyl, and $R^{11}$ as $C_3$–$C_5$ alkenoyl is especially acryloyl.

$R^{12}$ as a monovalent radical of a carboxylic acid is, for example, an acetic acid, caproic acid, stearic acid, acrylic acid, methacrylic acid, benzoic acid or $\beta$-(3,5-di-tert-butyl-4-hydroxyphenyl)propionic acid radical.

$R^{12}$ as a divalent radical of a dicarboxylic acid is, for example, a malonic acid, succinic acid, glutaric acid, adipic acid, suberic acid, sebacic acid, maleic acid, itaconic acid, phthalic acid, dibutylmalonic acid, dibenzylmalonic acid, butyl(3,5-di-tert-butyl-4-hydroxybenzyl)-malonic acid or bicycloheptenedicarboxylic acid radical.

$R^{12}$ as a trivalent radical of a tricarboxylic acid is e.g. a trimellitic acid, citric acid or nitrilotriacetic acid radical.

$R^{12}$ as a tetravalent radical of a tetracarboxylic acid is e.g. the tetravalent radical of butane-1,2,3,4-tetracarboxylic acid or of pyromellitic acid.

$R^{12}$ as a divalent radical of a dicarbamic acid is, for example, a hexamethylenedicarbamic acid or 2,4-toluylenedicarbamic acid radical.

Preferred compounds of formula III are those in which R is hydrogen, $R^{11}$ is hydrogen or methyl, n is 1 and $R^{12}$ is $C_1$–$C_{18}$ alkyl or n is 2 and $R^{12}$ is the diacyl radical of an aliphatic dicarboxylic acid having 4–12 C atoms.

The following compounds are examples of polyalkylpiperidine compounds of this class:

1) 4-hydroxy-2,2,6,6-tetramethylpiperidine
2) 1-allyl-4-hydroxy-2,2,6,6-tetramethylpiperidine
3) 1-benzyl-4-hydroxy-2,2,6,6-tetramethylpiperidine
4) 1-(4-tert-butylbut-2-enyl)-4-hydroxy-2,2,6,6-tetramethylpiperidine
5) 4-stearoyloxy-2,2,6,6-tetramethylpiperidine
6) 1-ethyl-4-salicyloyloxy-2,2,6,6-tetramethylpiperidine
7) 4-methacryloyloxy-1,2,2,6,6-pentamethylpiperidine
8) 1,2,2,6,6-pentamethylpiperidin-4-yl $\beta$-(3,5-di-tert-butyl-4-hydroxyphenyl)propionate
9) di(1-benzyl-2,2,6,6-tetramethylpiperidin-4-yl) maleate
10) di(2,2,6,6-tetramethylpiperidin-4-yl) succinate
11) di(2,2,6,6-tetramethylpiperidin-4-yl) glutarate
12) di(2,2,6,6-tetramethylpiperidin-4-yl) adipate
13) di(2,2,6,6-tetramethylpiperidin-4-yl) sebacate
14) di(1,2,2,6,6-pentamethylpiperidin-4-yl) sebacate
15) di(1,2,3,6-tetramethyl-2,6-diethylpiperidin-4-yl) sebacate
16) di(1-allyl-2,2,6,6-tetramethylpiperidin-4-yl) phthalate
17) 1-hydroxy-4-$\beta$-cyanoethoxy-2,2,6,6-tetramethylpiperidine
18) 1-acetyl-2,2,6,6-tetramethylpiperidin-4-yl acetate
19) tri(2,2,6,6-tetramethylpiperidin-4-yl) trimellitate
20) 1-acryloyl-4-benzyloxy-2,2,6,6-tetramethylpiperidine
21) di(2,2,6,6-tetramethylpiperidin-4-yl) diethylmalonate
22) di(1,2,2,6,6-pentamethylpiperidin-4-yl) dibutylmalonate
23) di(1,2,2,6,6-pentamethylpiperidin-4-yl) butyl(3,5-di-tert-butyl-4-hydroxybenzyl)malonate
24) di(1-octyloxy-2,2,6,6-tetramethylpiperidin-4-yl) sebacate
25) di(1-cyclohexyloxy-2,2,6,6-tetramethylpiperidin-4-yl) sebacate
26) hexane-1',6'-bis(4-carbamoyloxy-1-n-butyl-2,2,6,6-tetramethylpiperidine)
27) toluene-2',4'-bis(4-carbamoyloxy-1-n-propyl-2,2,6,6-tetramethylpiperidine)
28) dimethyl-bis(2,2,6,6-tetramethylpiperidin-4-oxy)silane
29) phenyl-tris(2,2,6,6-tetramethylpiperidin-4-oxy)silane
30) tris(1-propyl-2,2,6,6-tetramethylpiperidin-4-yl) phosphite
31) tris(1-propyl-2,2,6,6-tetramethylpiperidin-4-yl) phosphate
32) phenyl[bis(1,2,2,6,6-pentamethylpiperidin-4-yl)] phosphonate
33) 4-hydroxy-1,2,2,6,6-pentamethylpiperidine
34) 4-hydroxy-N-hydroxyethyl-2,2,6,6-tetramethylpiperidine
35) 4-hydroxy-N-(2-hydroxypropyl)-2,2,6,6-tetramethylpiperidine
36) 1-glycidyl-4-hydroxy-2,2,6,6-tetramethylpiperidine b) Compounds of formula IV

IV

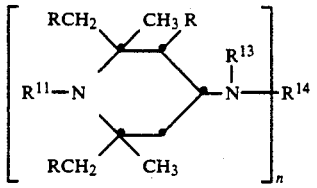

wherein n is the number 1 or 2, R and $R^{11}$ are as defined under a), $R^{13}$ is hydrogen, $C_1$–$C_{12}$ alkyl, $C_2$–$C_5$ hydroxyalkyl, $C_5$–$C_7$ cycloalkyl, $C_7$–$C_8$ aralkyl, $C_2$–$C_{18}$ alkanoyl, $C_3$–$C_5$ alkenoyl, benzoyl or a group of the formula

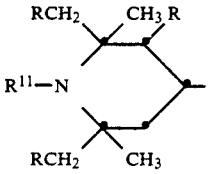

and $R^{14}$ when n is 1 is hydrogen, $C_1$–$C_{18}$ alkyl, $C_3$–$C_8$ alkenyl, $C_5$–$C_7$ cycloalkyl, $C_1$–$C_4$ alkyl substituted by a hydroxyl, cyano, alkoxycarbonyl or carbamide group, glycidyl or a group of the formula —$CH_2$—CH(OH)—Z or of the formula —CONH—Z, wherein Z is hydrogen, methyl or phenyl, $R^{14}$ when n is 2 is $C_2$–$C_{12}$ alkylene, $C_6$–$C_{12}$ arylene, xylylene, a group —$CH_2$—CH(OH)—$CH_2$— or a group —$CH_2$—CH(OH)—$CH_2$—O—D—O—, wherein D is $C_2$–$C_{10}$ alkylene, $C_6$–$C_{15}$ arylene or $C_6$–$C_{12}$ cycloalkylene, or, provided that $R^{13}$ is not alkanoyl, alkenoyl or benzoyl, $R^{14}$ can also be a divalent radical of an aliphatic, cycloaliphatic or aromatic dicarboxylic acid or dicarbamic acid or the group —CO—, or $R^{13}$ and $R^{14}$ together, when n is 1, can be the divalent radical of an aliphatic, cycloaliphatic or aromatic 1,2- or 1,3-dicarboxylic acid.

Any $C_1$–$C_{12}$ or $C_1$–$C_{18}$ alkyl substituents are as already defined under a).

Any $C_5$–$C_7$ cycloalkyl substituents are especially cyclohexyl.

$R^{13}$ as $C_7$–$C_8$ aralkyl is especially phenylethyl or in particular benzyl.

$R^{13}$ as $C_2$–$C_5$ hydroxyalkyl is especially 2-hydroxyethyl or 2-hydroxypropyl.

$R^{13}$ as $C_2$–$C_{18}$ alkanoyl is, for example, propionyl, butyryl, octanoyl, dodecanoyl, hexadecanoyl or octadecanoyl, but preferably acetyl, and $R^{13}$ as $C_3$–$C_5$ alkenoyl is especially acryloyl.

$R^{14}$ as $C_2$–$C_8$ alkenyl is e.g. allyl, methallyl, but-2-enyl, pent-2-enyl, hex-2-enyl or oct-2-enyl.

$R^{14}$ as $C_1$–$C_4$ alkyl substituted by a hydroxyl, cyano, alkoxycarbonyl or carbamide group can be e.g. 2-hydroxyethyl, 2-hydroxypropyl, 2-cyanoethyl, methoxycarbonylmethyl, 2-ethoxycarbonylethyl, 2-aminocarbonylpropyl or 2-(dimethylaminocarbonyl)ethyl.

Any $C_2$–$C_{12}$ alkylene substituents are e.g. ethylene, propylene, 2,2-dimethylpropylene, tetramethylene, hexamethylene, octamethylene, decamethylene or dodecamethylene.

Any $C_6$–$C_{15}$ arylene substituents are e.g. o-, m- or p-phenylene, 1,4-naphthylene or 4,4'-diphenylene. D as $C_6$–$C_{12}$ cycloalkylene is especially cyclohexylene.

Preferred compounds of formula IV are those in which n is 1 or 2, R is hydrogen, $R^{11}$ is hydrogen or methyl, $R^{13}$ is hydrogen, $C_1$–$C_{12}$ alkyl or a group of the formula

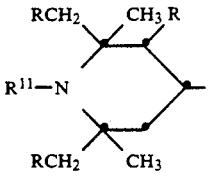

and $R^{14}$ in the case where n=1 is hydrogen or $C_1$–$C_{12}$ alkyl and in the case where n=2 is $C_2$–$C_8$ alkylene.

The following compounds are examples of polyalkylpiperidine compounds of this class:

37) N,N'-bis(2,2,6,6-tetramethylpiperidin-4-yl)hexamethylene-1,6-diamine

38) N,N'-bis(2,2,6,6-tetramethylpiperidin-4-yl)hexamethylene-1,6-diacetamide 39) bis(2,2,6,6-tetramethylpiperidin-4-yl)amine 40) 4-benzoylamino-2,2,6,6-tetramethylpiperidine 41) N,N'-bis(2,2,6,6-tetramethylpiperidin-4-yl)-N,N'-dibutyladipamide 42) N,N'-bis(2,2,6,6-tetramethylpiperidin-4-yl)-N,N'-dicyclohexyl-2-hydroxypropylene-1,3-diamine 43) N,N'-bis(2,2,6,6-tetramethylpiperidin-4-yl)-p-xylylenediamine 44) N,N'-bis(2,2,6,6-tetramethylpiperidin-4-yl)succindiamide 45) di(2,2,6,6-tetramethylpiperidin-4-yl) N-(2,2,6,6-tetramethylpiperidin-4-yl)-β-aminodipropionate 46) the compound of the formula

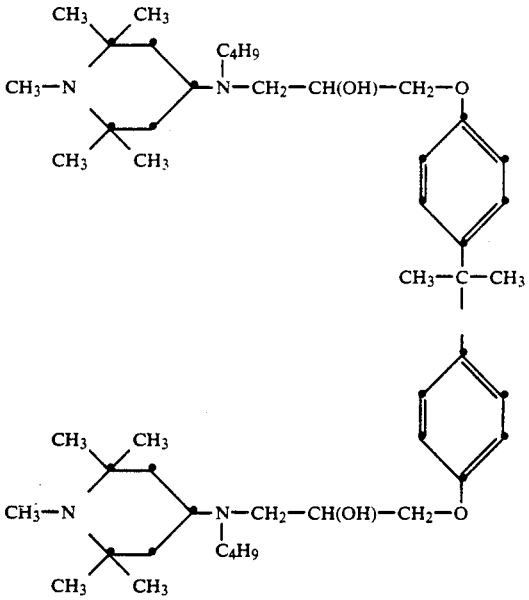

47) 4-(bis-2-hydroxyethylamino)-1,2,2,6,6-pentamethylpiperidine 48) 4-(3-methyl-4-hydroxy-5-tert-butylbenzamido)-2,2,6,6-tetramethylpiperidine 49) 4-methacrylamido-1,2,2,6,6-pentamethylpiperidine c) Compounds of formula V

V

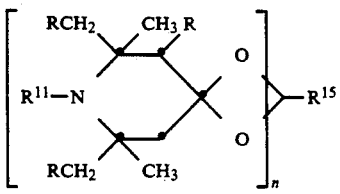

wherein n is the number 1 or 2, R and $R^{11}$ are as defined under a) and $R^{15}$ when n is 1 is $C_2$–$C_8$ alkylene, $C_2$–$C_8$ hydroxyalkylene or $C_4$–$C_{22}$ acyloxyalkylene and when n is 2 is the group $(—CH_2)_2C(CH_2—)_2$.

$R^{15}$ as $C_2$–$C_8$ alkylene or $C_2$–$C_8$ hydroxyalkylene is, for example, ethylene, 1-methylethylene, propylene, 2-ethylpropylene or 2-ethyl-2-hydroxymethylpropylene.

$R^{15}$ as $C_4$–$C_{22}$ acyloxyalkylene is e.g. 2-ethyl-2-acetoxymethylpropylene.

The following compounds are examples of polyalkylpiperidine compounds of this class:

50) 9-aza-8,8,10,10-tetramethyl-1,5-dioxaspiro[5.5]undecane 51) 9-aza-8,8,10,10-tetramethyl-3-ethyl-1,5-dioxaspiro[5.5]undecane 52) 8-aza-2,7,7,8,9,9-hexamethyl-1,4-dioxaspiro[4.5]decane 53) 9-aza-3-hydroxymethyl-3-ethyl-8,8,9,10,10-pentamethyl-1,5-dioxaspiro[5.5]undecane 54) 9-aza-3-ethyl-3-acetoxymethyl-9-acetyl-8,8,10,10-tetramethyl-1,5-dioxaspiro[5.5]undecane 55) 2,2,6,6-tetramethylpiperidine-4-spiro-2'-(1',3'-dioxane)-5'-spiro-5''-(1'',3''-dioxane)-2''-spiro-4'''-(2''',2''',6''',6'''-tetramethylpiperidine)

d) Compounds of formulae VIA, VIB and VIC

VIA

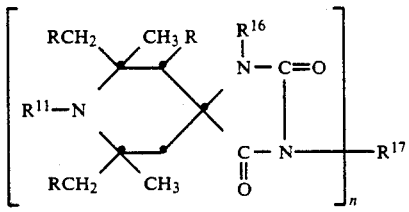

VIB

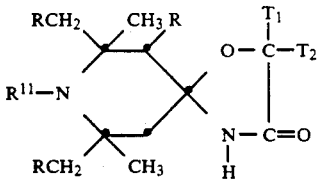

VIC

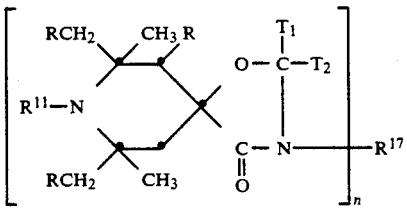

wherein n is the number 1 or 2, R and $R^{11}$ are as defined under a), $R^{16}$ is hydrogen, $C_1$–$C_{12}$ alkyl, allyl, benzyl, glycidyl or $C_2$–$C_6$ alkoxyalkyl, $R^{17}$ when n is 1 is hydrogen, $C_1$–$C_{12}$ alkyl, $C_3$–$C_5$ alkenyl, $C_7$–$C_9$ aralkyl, $C_5$–$C_7$ cycloalkyl, $C_2$–$C_4$ hydroxyalkyl, $C_2$–$C_6$ alkoxyalkyl, $C_6$–$C_{10}$ aryl, glycidyl or a group of the formula $—(CH_2)_p—COO—Q$ or of the formula $—(CH_2)_p—O—CO—Q$, wherein p is 1 or 2 and Q is $C_1$–$C_4$ alkyl or phenyl, and $R^{17}$ when n is 2 is $C_2$–$C_{12}$ alkylene, $C_4$–$C_{12}$ alkenylene, $C_6$–$C_{12}$ arylene, a group $—CH_2—CH(OH)—CH_2—O—D—O—CH_2—CH(OH)—CH_2—$, wherein D is $C_2$–$C_{10}$ alkylene, $C_6$–$C_{15}$ arylene or $C_6$–$C_{12}$ cycloalkylene, or a group $—CH_2CH(OZ')CH_2—(OCH_2—CH(OZ')CH_2)_2—$, wherein Z' is hydrogen, $C_1$–$C_{18}$ alkyl, allyl, benzyl, $C_2$–$C_{12}$ alkanoyl or benzoyl, and $T_1$ and $T_2$ independently of the other are hydrogen, $C_1$–$C_{18}$ alkyl or $C_6$–$C_{10}$ aryl or $C_7$–$C_9$ aralkyl which is unsubstituted or substituted by halogen or $C_1$–$C_4$ alkyl, or $T_1$ and $T_2$ form a $C_5$–$C_{12}$ cycloalkane ring together with the C atom to which they are bonded.

Any $C_1$–$C_{12}$ alkyl substituents are e.g. methyl, ethyl, n-propyl, n-butyl, sec-butyl, tert-butyl, n-hexyl, n-octyl, 2-ethylhexyl, n-nonyl, n-decyl, n-undecyl or n-dodecyl.

Any $C_1$–$C_{18}$ alkyl substituents can be e.g. the groups listed above and additionally n-tridecyl, n-tetradecyl, n-hexadecyl or n-octadecyl, for example.

Any $C_2$–$C_6$ alkoxyalkyl substituents are e.g. methoxymethyl, ethoxymethyl, propoxymethyl, tert-butoxymethyl, ethoxyethyl, ethoxypropyl, n-butoxyethyl, tert-butoxyethyl, isopropoxyethyl or propoxypropyl.

$R^{17}$ as $C_3$–$C_5$ alkenyl is e.g. prop-1-enyl, allyl, methallyl, but-2-enyl or pent-2-enyl.

$R^{17}$, $T_1$ and $T_2$ as $C_7$–$C_9$ aralkyl are especially phenethyl or in particular benzyl. If $T_1$ and $T_2$ form a cycloalkane ring together with the C atom, said ring can be e.g. a cyclopentane, cyclohexane, cyclooctane or cyclododecane ring.

$R^{17}$ as $C_2$–$C_4$ hydroxyalkyl is e.g. 2-hydroxyethyl, 2-hydroxypropyl, 2-hydroxybutyl or 4-hydroxybutyl.

$R^{17}$, $T_1$ and $T_2$ as $C_6$–$C_{10}$ aryl are especially phenyl or $\alpha$- or $\beta$-naphthyl which are unsubstituted or substituted by halogen or $C_1$–$C_4$ alkyl.

$R^{17}$ as $C_2$–$C_{12}$ alkylene is e.g. ethylene, propylene, 2,2-dimethylpropylene, tetramethylene, hexamethylene, octamethylene, decamethylene or dodecamethylene.

$R^{17}$ as $C_4$–$C_{12}$ alkenylene is especially but-2-enylene, pent-2-enylene or hex-3-enylene.

$R^{17}$ as $C_6$–$C_{12}$ arylene is, for example, o-, m- or p-phenylene, 1,4-naphthylene or 4,4'-diphenylene.

Z' as $C_2$–$C_{12}$ alkanoyl is, for example, propionyl, butyryl, octanoyl or dodecanoyl, but preferably acetyl.

D as $C_2$–$C_{10}$ alkylene, $C_6$–$C_{15}$ arylene or $C_6$–$C_{12}$ cycloalkylene is as defined under b).

The following compounds are examples of polyalkylpiperidine compounds of this class:

56) 3-benzyl-1,3,8-triaza-7,7,9,9-tetramethylspiro[4.5]decane-2,4-dione 57) 3-n-octyl-1,3,8-triaza-7,7,9,9-tetramethylspiro[4.5]decane-2,4-dione 58) 3-allyl-1,3,8-triaza-1,7,7,9,9-pentamethylspiro[4.5]decane-2,4-dione 59) 3-glycidyl-1,3,8-triaza-7,7,8,9,9-pentamethylspiro[4.5]decane-2,4-dione 60) 1,3,7,7,8,9,9-heptamethyl-1,3,8-triazaspiro[4.5]decane-2,4-dione 61) 2-isopropyl-7,7,9,9-tetramethyl-1-oxa-3,8-diaza-4-oxospiro[4.5]decane 62) 2,2-dibutyl-7,7,9,9-tetramethyl-1-oxa-3,8-diaza-4-oxospiro[4.5]decane 63) 2,2,4,4-tetramethyl-7-oxa-3,20-diaza-21-oxodispiro[5.1.11.2]heneicosane 64) 2-butyl-7,7,9,9-tetramethyl-1-oxa-4,8-diaza-3-oxospiro[4.5]decane 65) 8-acetyl-3-dodecyl-1,3,8-triaza-7,7,9,9-tetramethylspiro[4.5]decane-2,4-dione or the compounds of the following formulae:

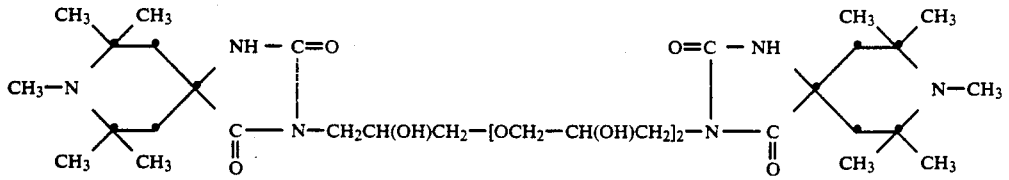

66)

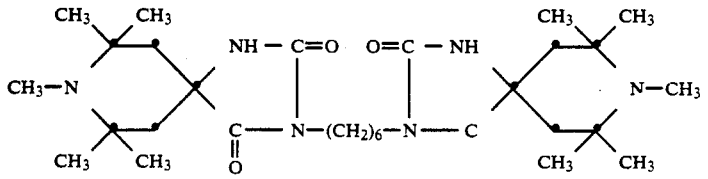

67)

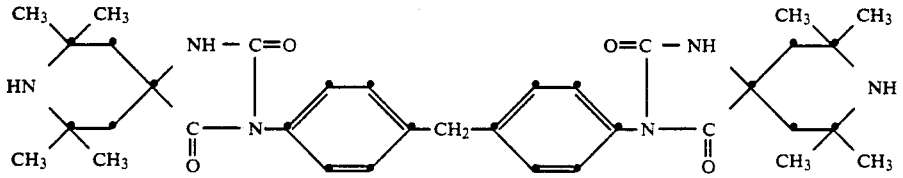

68)

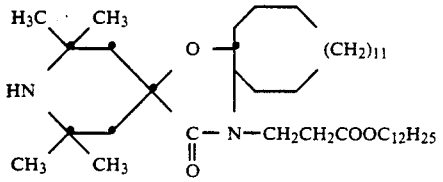

69)

e) Compounds of formula VII

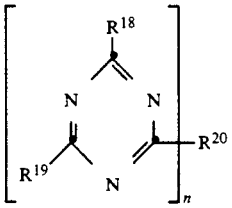

VII wherein n is the number 1 or 2, $R^{18}$ is a group of the formula

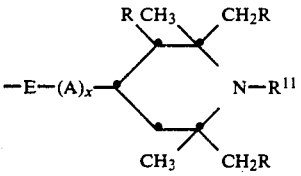

wherein R and $R^{11}$ are as defined under a), E is —O— or —$NR^{21}$—, A is $C_2$-$C_6$ alkylene or —$(CH_2)_3$—O— and x is the number 0 or 1, $R^{19}$ is the same as $R^{18}$ or is one of the groups —$NR^{21}R^{22}$, —$OR^{23}$, —$NHCH_2OR^{23}$ and —$N(CH_2OR^{23})_2$, $R^{20}$ when n=1 is the same as $R^{18}$ or $R^{19}$ and when n=2 is a group —E—B—E—, wherein B is $C_2$-$C_6$ alkylene which may be interrupted by —$N(R^{21})$—, $R^{21}$ is $C_1$-$C_{12}$ alkyl, cyclohexyl, benzyl, $C_1$-$C_4$ hydroxyalkyl or a group of the formula

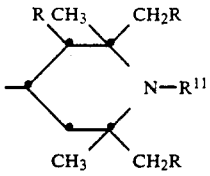

$R^{22}$ is $C_1$-$C_{12}$ alkyl, cyclohexyl, benzyl or $C_1$-$C_4$ hydroxyalkyl and $R^{23}$ is hydrogen, $C_1$-$C_{12}$ alkyl or phenyl, or $R^{21}$ and $R^{22}$ together are $C_4$-$C_5$ alkylene or $C_4$-$C_5$ oxaalkylene, for example

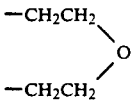

or a group of the formula

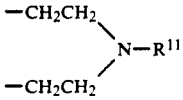

or $R^{21}$ and $R^{22}$ are each a group of the formula

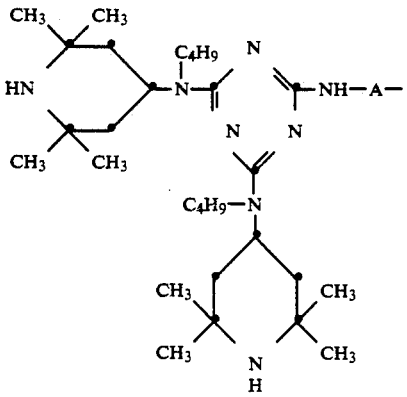

Any $C_1$–$C_{12}$ alkyl substituents are, for example, methyl, ethyl, n-propyl, n-butyl, sec-butyl, tert-butyl, n-hexyl, n-octyl, 2-ethylhexyl, n-nonyl, n-decyl, n-undecyl or n-dodecyl.

Any $C_1$–$C_4$ hydroxyalkyl substituents are e.g. 2-hydroxyethyl, 2-hydroxypropyl, 3-hydroxypropyl, 2-hydroxybutyl or 4-hydroxybutyl.

A as $C_2$–$C_6$ alkylene is, for example, ethylene, propylene, 2,2-dimethylpropylene, tetramethylene or hexamethylene.

If $R^{21}$ and $R^{22}$ together are $C_4$–$C_5$ alkylene or $C_4$–$C_5$ oxaalkylene, this is e.g. tetramethylene, pentamethylene or 3-oxapentamethylene.

The compounds of the following formulae are examples of polyalkylpiperidine compounds of this class:

70)

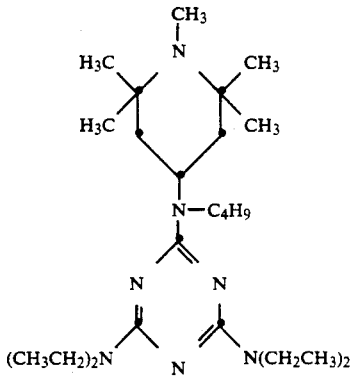

71)

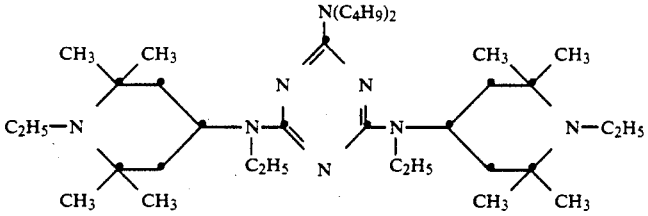

72)

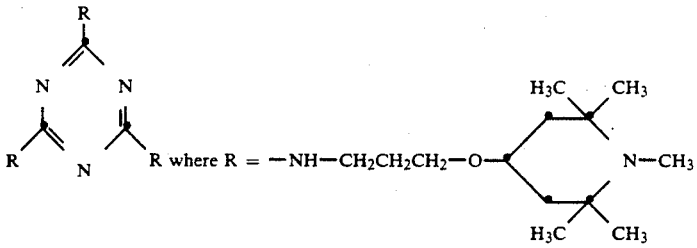

73)

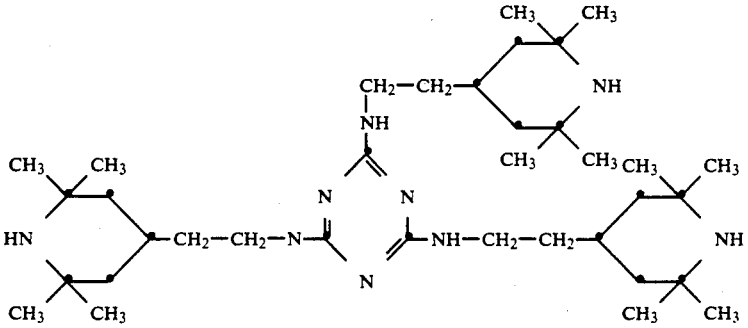

-continued
74)
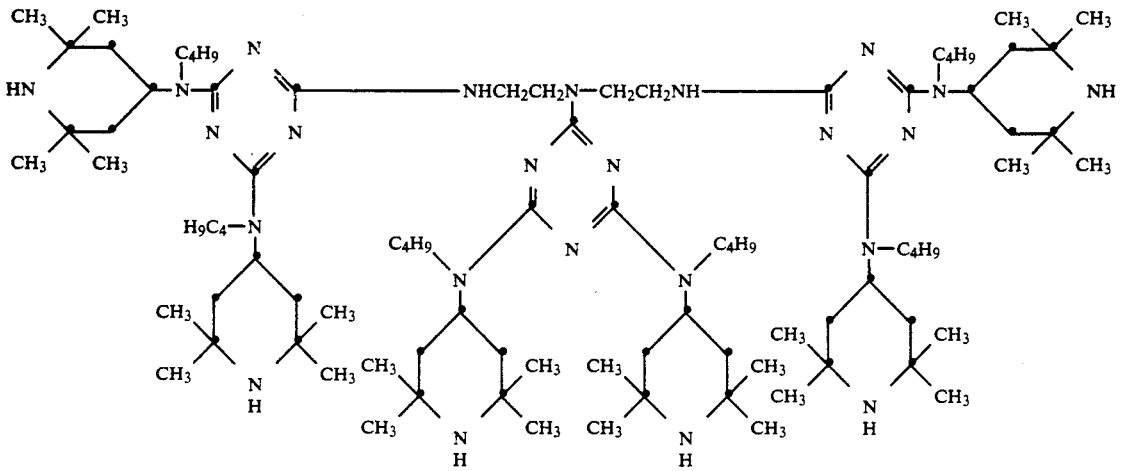
75)
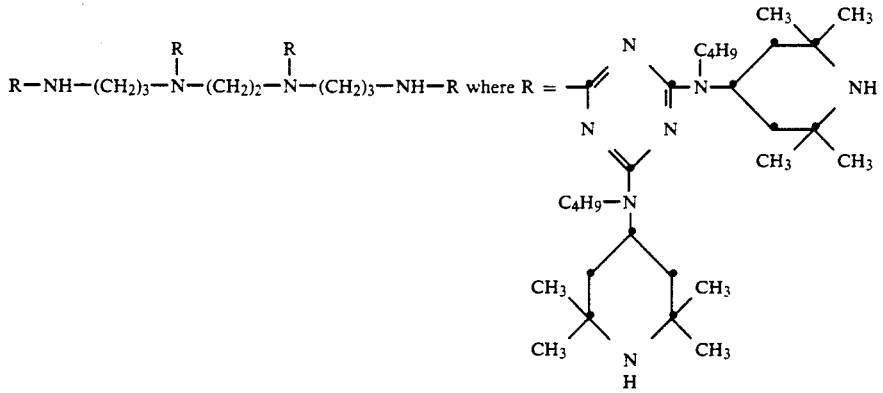
76)
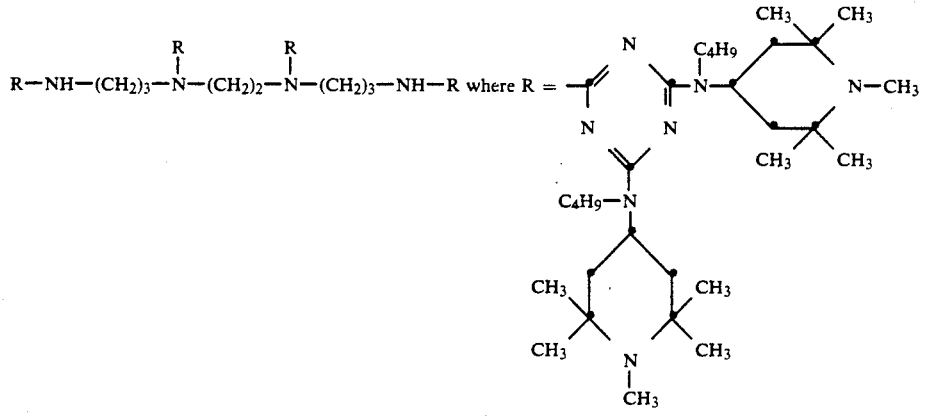

-continued
77)
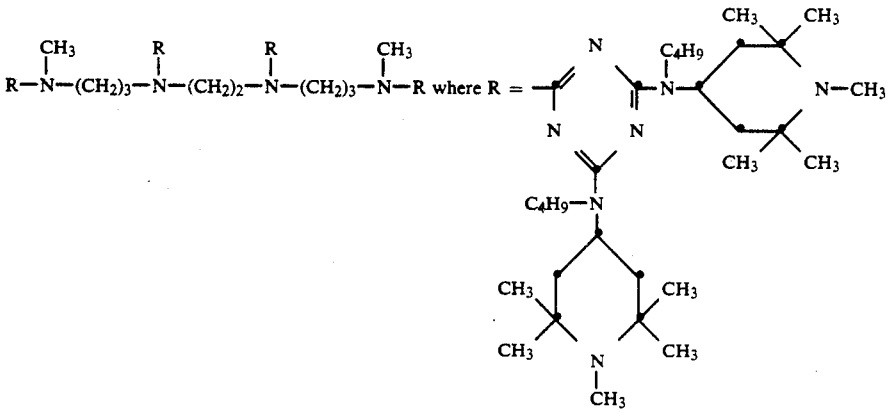
78)
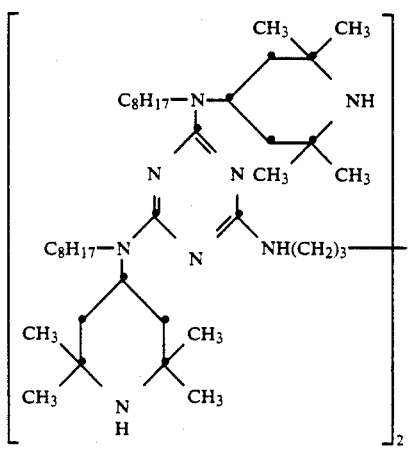
79)
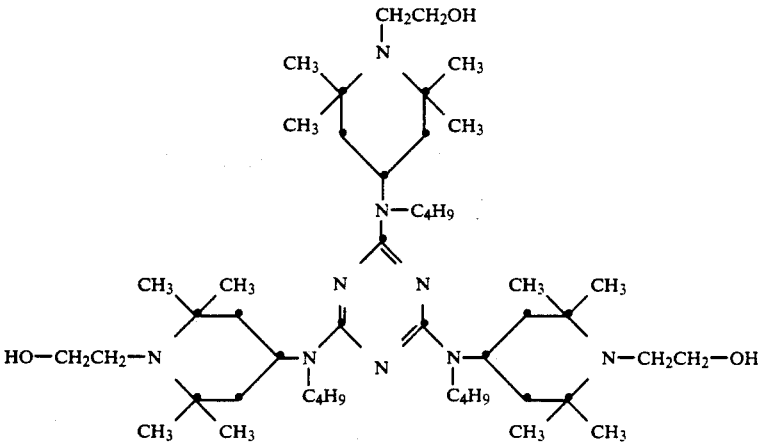

-continued

80)

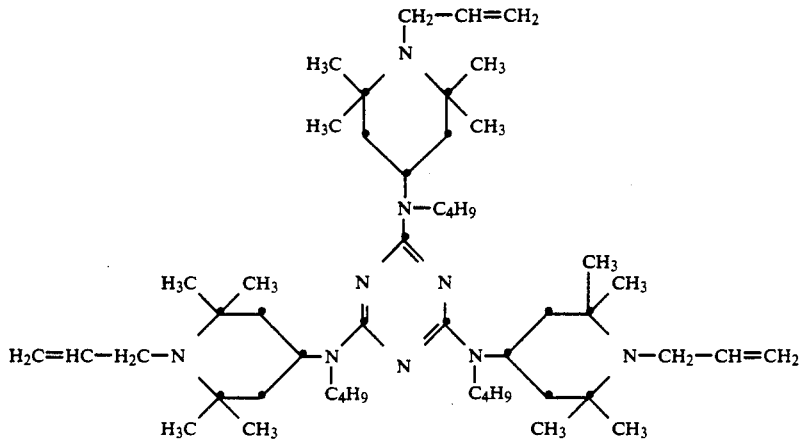

f) Oligomeric or polymeric compounds whose repeat structural unit contains a 2,2,6,6-tetraalkylpiperidine radical of formula (I), especially polyesters, polyethers, polyamides, polyamines, polyurethanes, polyureas, polyaminotriazines, poly(meth)acrylates, poly(meth)acrylamides and copolymers thereof which contain such radicals.

The compounds of the following formulae are examples of 2,2,6,6-polyalkylpiperidine light stabilizers of this class, m being a number from 2 to about 200:

81)

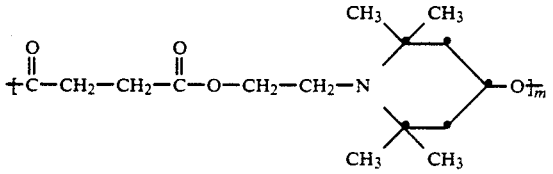

82)

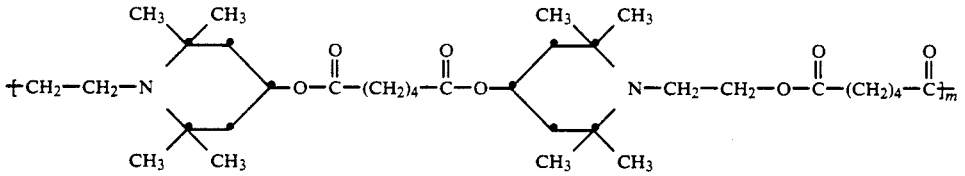

83)

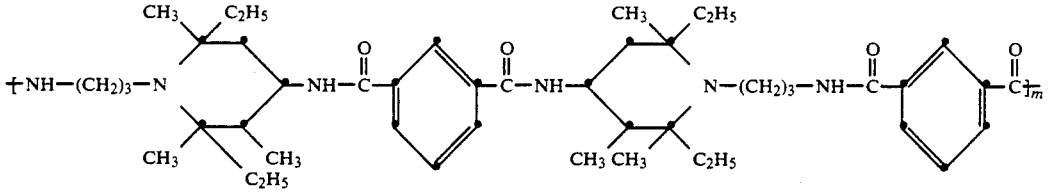

84)

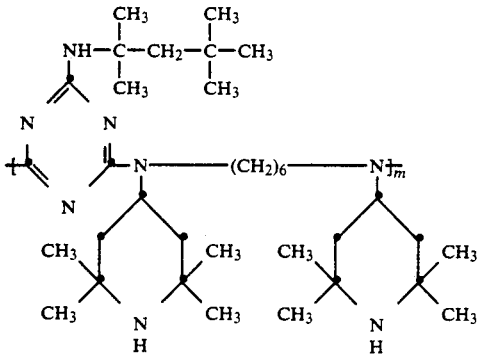

-continued
85)
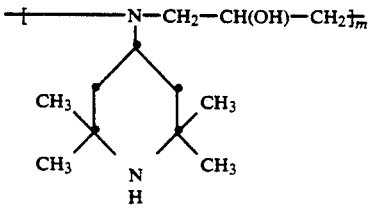
86)
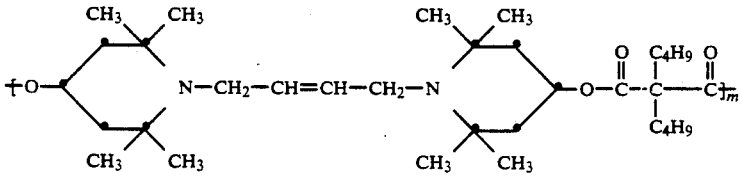
87)
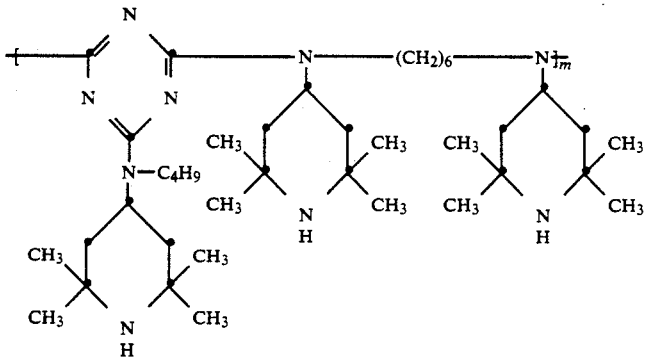
88)
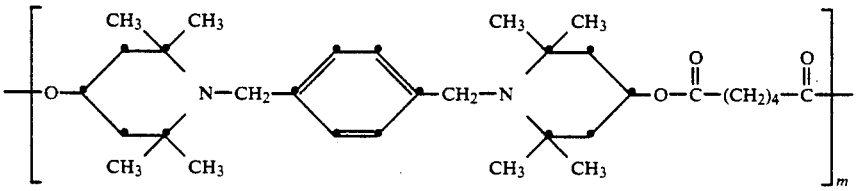
89)
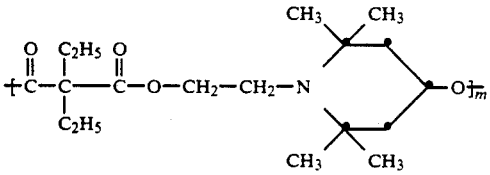
90)
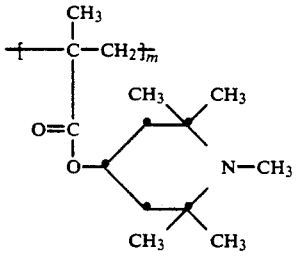
91)
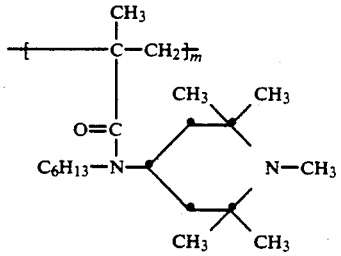

-continued

92)

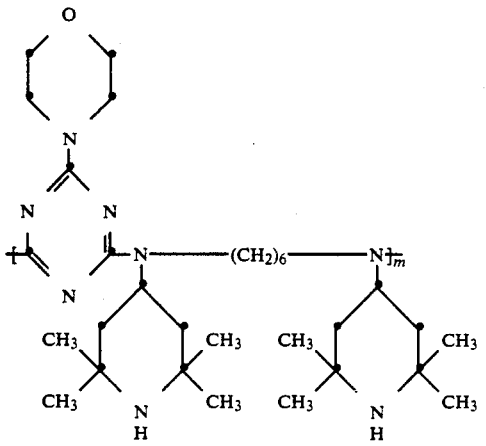

93)

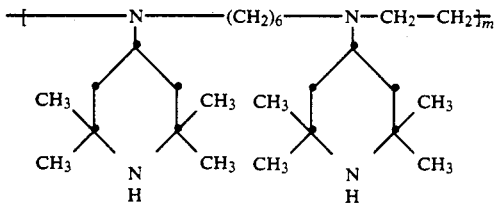

94)

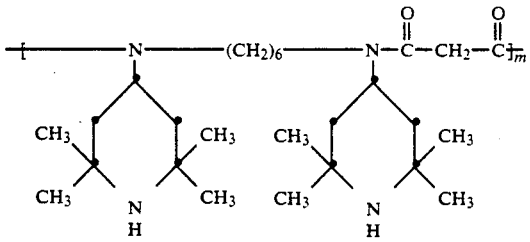

g) Compounds of formula VIII

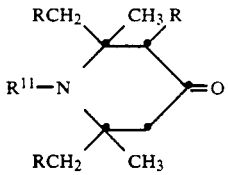

VIII wherein R and $R^{11}$ are as defined under a).

Preferred compounds of formula VIII are those in which R is hydrogen or methyl and $R^{11}$ is hydrogen or methyl.

Examples of such compounds are:

95) 2,2,6,6-tetramethylpiperidin-4-one (triacetonamine)
96) 1,2,2,6,6-pentamethylpiperidin-4-one
97) 1-oxyl-2,2,6,6-tetramethylpiperidin-4-one
98) 2,3,6-trimethyl-2,6-diethylpiperidin-4-one Polyalkylpiperidines are known compounds and are used as light stabilizers for organic materials. Some of them are commercially available.

Component (C) is a phenolic antioxidant. (C) is preferably a compound of formula I in which A is hydrogen, $C_1$-$C_8$ alkyl, cyclohexyl, phenyl or a group

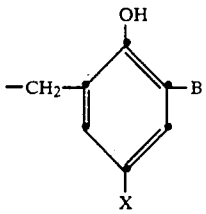

B is $C_1$-$C_8$ alkyl, cyclohexyl or phenyl, X is $C_1$-$C_8$ alkyl or one of the groups $-C_aH_{2a}-S-R^2$, $-C_bH_{2b}-COOR^3$, $-CH_2N(R^{10})(R^{11})$ and

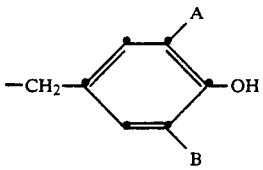

$R^2$ is $C_1$-$C_{12}$ alkyl, phenyl or a group $-(CH_2)_c-COOR^4$, $R^3$ is $C_1$-$C_{18}$ alkyl or a group

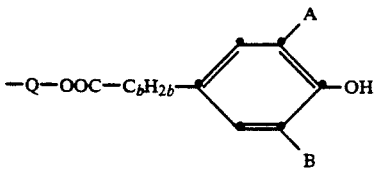

in which Q is $C_2$-$C_6$ alkylene, $—CH_2CH_2SCH_2CH_2—$ or $—CH_2CH_2(OCH_2CH_2)_d—$, $R^4$ is $C_1$-$C_{18}$ alkyl, $R^{10}$ and $R^{11}$ independently of of the other are $C_1$-$C_{12}$ alkyl or $R^{10}$ and $R^{11}$ together are pentamethylene or 3-oxapentamethylene, a is 1 or 2, b is 1 or 2, c is 1 or 2 and d is 1 to 3, or (C) is a reaction mixture of a phenol of the formula

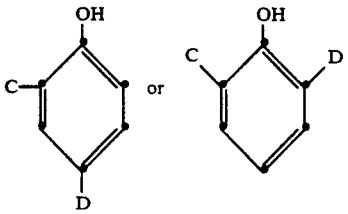

with a phenol of the formula

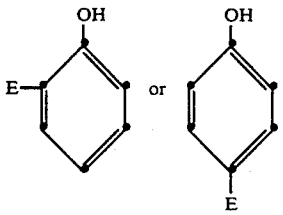

and (para)formaldehyde, in which formulae C, D and E independently of the others are $C_1$-$C_8$ alkyl.

One class which is particularly suitable as component (C) consists of the compounds of formula I in which A and B independently of the other are $C_1$-$C_4$ alkyl, X is a group $—C_aH_{2a}—S_q—R^2$, a is 0 or 1, q is 1 or 2, $R^2$ is $C_4$-$C_{18}$ alkyl, phenyl or $—CH_2—CO—OR^4$ and $R^4$ is $C_1$-$C_{18}$ alkyl, especially the compounds of formula I in which A and B independently of the other are $C_1$-$C_4$ alkyl, X is $—CH_2—S—R^2$, $R^2$ is $C_8$-$C_{12}$-alkyl or $—CH_2—CO—OR^4$ and $R^4$ is $C_8$-$C_{18}$ alkyl. In this class, especially preferred compounds of formula I are those in which A and B are tert-butyl and X is $—CH_2SCH_2COO(C_8$-$C_{13}$ alkyl).

Another class which is particularly suitable as component (C) consists of the compounds of formula I in which A and B independently of the other are $C_1$-$C_4$ alkyl, X is a group $—C_bH_{2b}—CO—OR^3$, b is 1 or 2 and $R^3$ is one of the groups

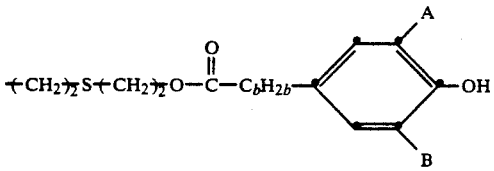

-continued

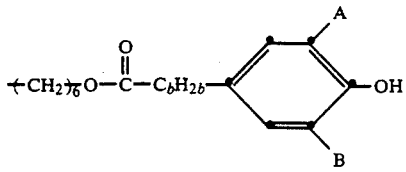

and

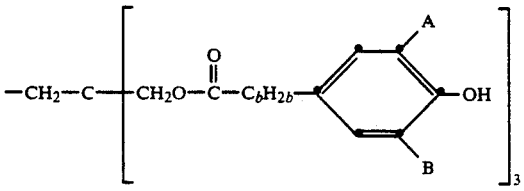

especially the compounds of formula I in which X is a group $—(CH_2)_2—CO—OR^3$ and $R^3$ is a group

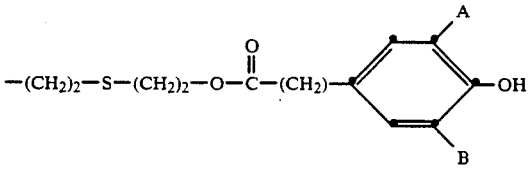

Another class which is particularly suitable as component (C) consists of the methylenebisphenols of the formula

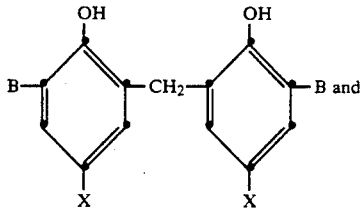

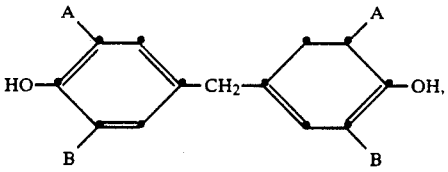

wherein A, B and X independently of the others are $C_1$-$C_{14}$ alkyl.

Another class which is particularly suitable as component (C) consists of mixtures of polyphenols obtained by reacting at least one dialkylated phenol of the formula

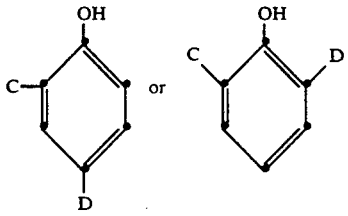

with at least one monoalkylated phenol of the formula

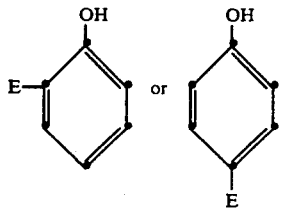

and formaldehyde or paraformaldehyde, C, D and E independently of the others being $C_1$–$C_4$ alkyl.

The mixtures formed by this reaction contain predominantly diphenols and triphenols.

Examples of compounds of formula I are: tridecyl 4-(4-hydroxy-3,5-di-tert-butylphenyl)-3thiabutyrate, 3-thiapenta-1,5-diol di[3-(4-hydroxy-3,5-di-tert-butylphenyl)]propionate, di(3-thiapentadecyl) di(4-hydroxy-3,5-di-tert-butylphenyl)malonate, octadecyl 4-(4-hydroxy-3,5-di-tert-butylphenyl)-3-thiabutyrate, 4-(2-thiapropyl)-2,6-di-tert-butylphenol, octadecyl 3-(4-hydroxy-3,5-di-tert-butylphenyl)propionate, 3-thiapentadecyl 3-(4-hydroxy-3,5-di-tert-butylphenyl)propionate, di(4-hydroxy-3,5-di-tert-butylphenyl) sulfide, di(4-hydroxy-3,5-di-tert-butylphenyl) disulfide, 2,4-di(octylthiomethyl)-6-methylphenol, N-octadecyl-3-(4-hydroxy-3,5-di-tert-butylphenyl)propionamide, N,N'-[3-(4-hydroxy-3,5-di-tert-butylphenyl)propionyl]hexamethylenediamine, 4,4'-methylene-bis(2,6-di-tert-butylphenol), 2,2'-methylene-bis(2-tert-butyl-4-methylphenol), 2,4-di(4-hydroxy-3,5-di-tert-butylbenzyl)-6-tert-butylphenol, 4,4'-methylene-bis[2-tert-butyl-4-(4-hydroxy-3,5-di-tert-butylbenzyl)phenol], 4-dimethylaminomethyl-2,6-di-tert-butylphenol, 4-dibutylaminomethyl-2-methyl-6-tert-butylphenol and N-di(4-hydroxy-3,5-di-tert-butylbenzyl)octylamine.

Especially preferred lubricant compositions are those in which (B) is a compound of formula IX or X

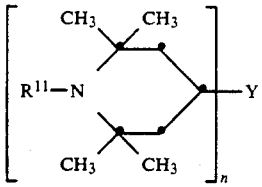

IX

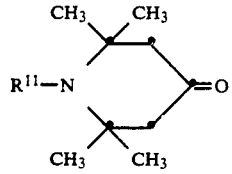

X in which n is 1 or 2, $R^{11}$ is hydrogen or methyl and Y when n is 1 is —O($C_8$–$C_{15}$ alkyl) and when n is 2 is a group —NH—$(CH_2)_6$—NH— or —O—CO—$(CH_2)_m$—CO—O— in which m is 2–8, and (C) is a compound of formula I in which A is hydrogen, $C_1$–$C_4$ alkyl or a group

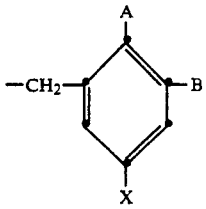

B is $C_1$–$C_4$ alkyl, X is $C_1$–$C_4$ alkyl or one of the groups —$CH_2$—S—$R^2$, —$CH_2CH_2COOR^3$, —$CH_2N(R^{10})(R^{11})$ and

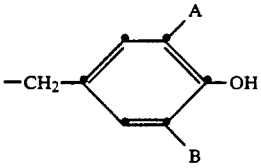

$R^2$ is $C_1$–$C_{18}$ alkyl or —$(CH_2)_2$—$COOR^4$, $R^3$ is $C_1$–$C_{18}$ alkyl or

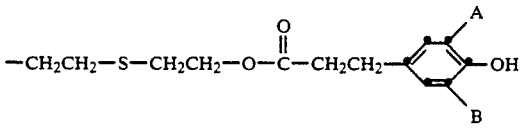

$R^4$ is $C_1$–$C_{18}$ alkyl and $R^{10}$ and $R^{11}$ are $C_1$–$C_8$ alkyl, or (C) is a reaction mixture of 2-tert-butylphenol, 2,6-di-tert-butylphenol and (para)formaldehyde.

Components (B) and (C) can be added direct to the base oil or (B) and (C) are first dissolved in a small amount of base oil, with heating if necessary, and the solution is mixed with the remainder of the oil. As a further possibility, a concentrated solution of (B) and (C) in a solvent is mixed with the oil.

The addition of (B) and (C) to the base oil stabilizes the oil against oxidative degradation and reduces the formation of sludge in engine oils.

The lubricant composition can additionally contain other additives, e.g. phosphorus(III) esters, metal passivators, rust inhibitors, agents for improving the viscosity index, pour point depressors, dispersants, surfactants and/or wearing protection additives.

Examples of phosphorus(III) esters are: triphenyl phosphite, decyldiphenyl phosphite, phenyldidecyl phosphite, tris(nonylphenyl) phosphite, trilauryl phosphite, trioctadecyl phosphite, distearylpentaerythritol diphosphite, tris(2,4-di-tert-butylphenyl) phosphite, diisodecylpentaerythritol diphosphite, bis(2,4-di-tert-butylphenyl)pentaerythritol diphosphite, tristearylsorbitol triphosphite, tetrakis(2,4-di-tert-butylphenyl)-4,4'-biphenylene diphosphonite and bis(2,6-di-tert-butyl-4-methylphenyl)pentaerythritol diphosphite.

Examples of metal passivators, e.g. for copper, are: triazoles, benzotriazoles and derivatives thereof, tolutriazoles and derivatives thereof, 2-mercaptobenzothiazole, 2-mercaptobenzotriazole, 2,5-dimercaptobenzotriazole, 2,5-dimercaptobenzothiadiazole, 5,5'-methylene-bis-benzotriazole, 4,5,6,7-tetrahydrobenzotriazole, salicylidenepropylenediamine, salicylaminoguanidine and salts thereof.

Examples of rust inhibitors are:

a) Organic acids and their esters, metal salts and anhydrides, e.g.: N-oleoylsarcosine, sorbitan monooleate, lead naphthenate, an alkenylsuccinic anhydride, e.g. dodecenylsuccinic anhydride, alkenylsuccinic acid partial esters and partial amides, 4-nonylphenoxyacetic acid.

b) Nitrogen-containing compounds, e.g.:

I. Primary, secondary or tertiary aliphatic or cycloaliphatic amines and amine salts of organic and inorganic acids, e.g. oil-soluble alkylammonium carboxylates.

II. Heterocyclic compounds, e.g.: substituted imidazolines and oxazolines.

c) Phosphorus-containing compounds, e.g.: amine salts of phosphoric acid partial esters or phosphonic acid partial esters, zinc dialkyldithiophosphates.

d) Sulfur-containing compounds, e.g.: barium dinonylnaphthalenesulfonates, calcium petroleumsulfonates.

Examples of agents for improving the viscosity index are: polyacrylates, polymethacrylates, vinylpyrrolidone/methacrylate copolymers, polyvinylpyrrolidones, polybutenes, olefin copolymers, styrene/acrylate copolymers, polyethers.

Examples of pour point depressors are: polymethacrylate, alkylated naphthalene derivatives.

Examples of dispersants/surfactants are: polybutenylsuccinamides or polybutenylsuccinimides, polybutenylphosphonic acid derivatives, basic magnesium, calcium and barium sulfonates and phenates.

Examples of wearing protection additives are: compounds containing sulfur and/or phosphorus and/or halogen, such as sulfurized vegetable oils, zinc dialkyldithiophosphates, tritolyl phosphate, chlorinated paraffins, alkyl and aryl disulfides and trisulfides, triphenyl phosphorothionates, diethanolaminomethyltolyltriazole, di(2-ethylhexyl)aminomethyltolyltriazole.

The lubricant can also contain solid lubricants such as graphite or molybdenum sulfide.

The following Examples illustrate the invention in greater detail. Percentages are by weight.

EXAMPLE 1

The oxidation behaviour of lubricating oils stabilized according to the invention is tested by the TOST (turbine oxidation stability test) method according to ASTM D-943.

This is performed by adding 60 ml of water to 300 ml of a mineral oil (Mobil STOCK 305) containing 0.05% of a corrosion inhibitor (Reocor ® 12) and heating the mixture at 95° C. for 1000 hours, in the presence of iron and copper wire, while oxygen is passed through. The formation of acids is measured by determining the neutralization number TAN (mg KOH/g oil) and the amount of sludge formed (=SLUDGE) is also measured.

The following stabilizers are used:

P-1

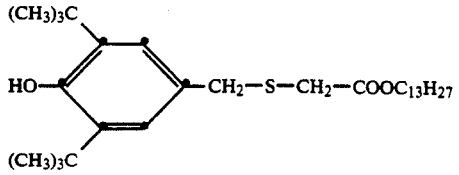

H-1

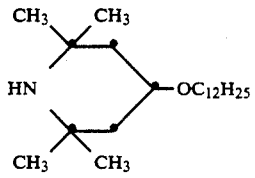

The total amount of stabilizers is 0.25%, based on the oil. The composition of the stabilizer mixture is varied. The results are listed in Table 1.

TABLE 1

| Proportion | | TOST | |
|---|---|---|---|
| P-1 | H-1 | TAN | SLUDGE |
| 100% | — | 0,19 | 64 mg |
| 95% | 5% | 0 | 17 mg |
| 90% | 10% | 0 | 8 mg |
| 75% | 25% | 0 | 26 mg |

EXAMPLE 2

Testing is carried out as in Example 1, using the following stabilizers:

P-2

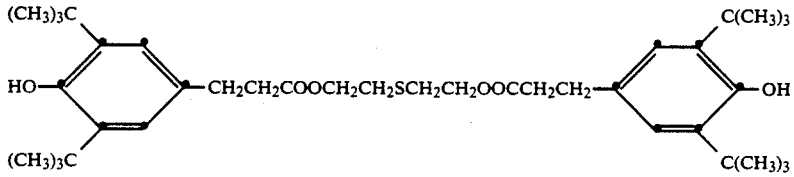

H-2

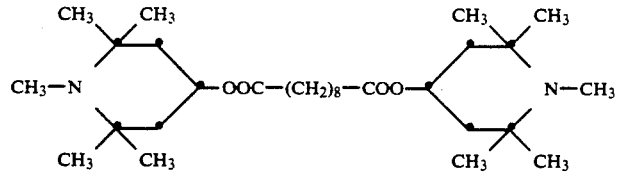

The total concentration is 0.25%, based on the oil.

TABLE 2

| Proportion | | TOST | |
|---|---|---|---|
| P-2 | H-2 | TAN | SLUDGE |
| 100% | — | >2 | >1000 mg |
| 95% | 5% | 0,26 | 219 mg |
| 90% | 10% | 0,24 | 190 mg |

EXAMPLE 3

Testing is carried out as in Example 1, using the following stabilizers:

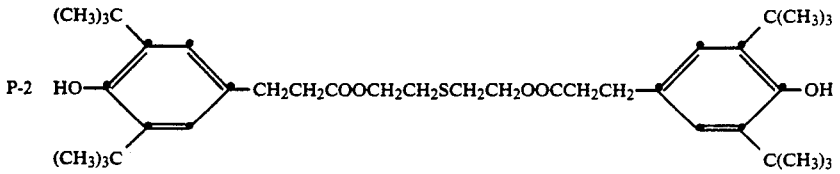

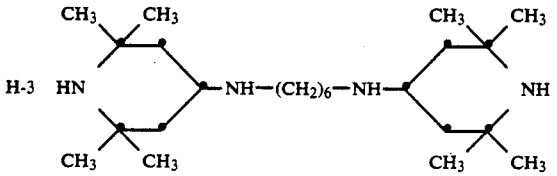

The total concentration is 0.25%. The results are listed in Table 3.

TABLE 3

| Proportion | | TOST | |
|---|---|---|---|
| P-2 | H-3 | TAN | SLUDGE |
| 100% | — | >2 | >1000 mg |
| 95% | 5% | 0,24 | 180 mg |

EXAMPLE 4

Testing is carried out as in Example 1, using the following stabilizers:

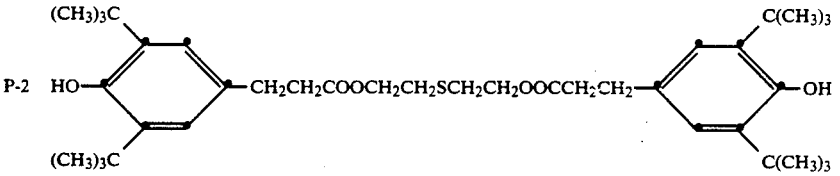

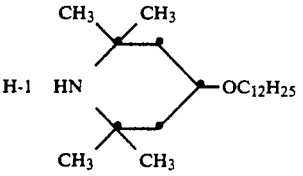

The total concentration is 0.25%. The results are listed in Table 4.

TABLE 4

| Proportion | | TOST | |
|---|---|---|---|
| P-2 | H-1 | TAN | SLUDGE |
| 100% | — | >2 | 1000 mg |
| 95% | 5% | 0 | 86 mg |
| 85% | 15% | 0,10 | 44 mg |
| 75% | 25% | 0,03 | 75 mg |

EXAMPLE 5

Testing is carried out as in Example 1, using the following stabilizers:

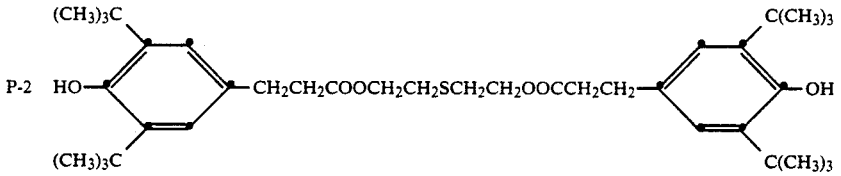

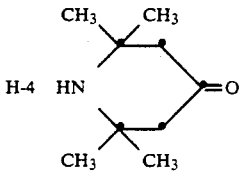

The total concentration is 0.25%. The results are listed in Table 5.

TABLE 5

| Proportion | | TOST | |
|---|---|---|---|
| P-2 | H-4 | TAN | SLUDGE |
| 100% | — | >2 | >1000 mg |

TABLE 5-continued

| Proportion | | TOST | |
|---|---|---|---|
| P-2 | H-4 | TAN | SLUDGE |
| 95% | 5% | 0,18 | 91 mg |
| 90% | 10% | 0,16 | 161 mg |

EXAMPLE 6

The oxidation resistance of the oils stabilized according to the invention is measured in a differential scanning calorimeter. To do this, a base oil is mixed in a small Al dish with 0.025% of iron(III) acetylacetonate (as oxidation catalyst) and 0.55% of a stabilizer and the mixture is heated isothermally at 160° C. in a calorimeter under 10 bar of oxygen. The time at which the exothermic reaction begins, $T_B$ (induction time), and the time at which the exothermic reaction ends, $T_E$, are measured: the longer the induction time, the higher the oxidation resistance. The stabilizers used are the phenolic antioxidants P-1 and P-2 and also:

P-3: the reaction product of 160 g of 2,6-di-tert-butylphenol, 40 g of 2-tert-butylphenol, 5.8 g of KOH, 50 ml of ethanol and 24 g of paraformaldehyde at 80° C., containing the following main components:

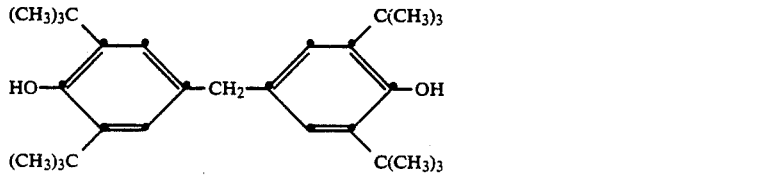

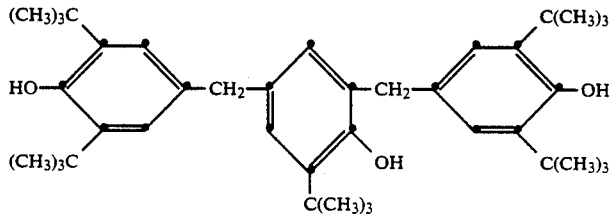

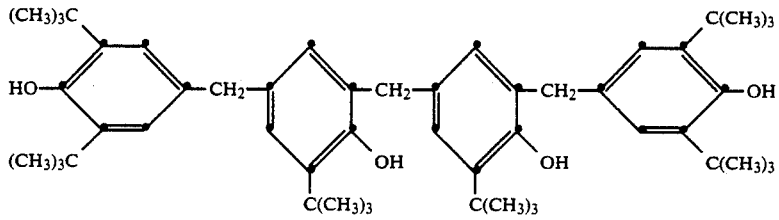

P-4:

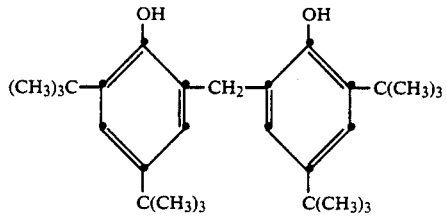

P-5: a 1:1 mixture of

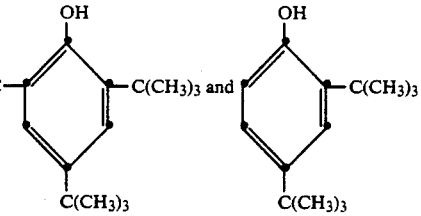

The following sterically hindered amine is used:

H-5

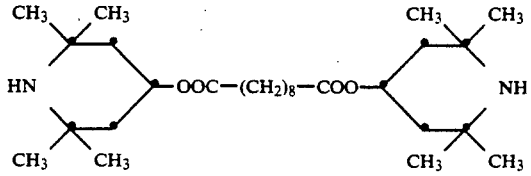

The results are listed in Table 6.

TABLE 6

| Stabilizer | $T_B$ (min) | $T_E$ (min) |
|---|---|---|
| 0,55% P-1 | 1,47 | 9,12 |
| 0,55% H-5 | 17,16 | 22,97 |
| 0,45% P-1 + 0,10% H-5 | 14,02 | 27,71 |
| 0,55% P-2 | 16,08 | 26,07 |
| 0,55% H-5 | 17,16 | 22,97 |
| 0,45% P-2 + 0,10% H-5 | 32,27 | 47,90 |
| 0,55% P-3 | 7,21 | 14,20 |
| 0,55% H-5 | 17,16 | 22,97 |
| 0,45% P-3 + 0,10% H-5 | 50,55 | 67.97 |
| 0,55% P-4 | 3,00 | 9,67 |
| 0,55% H-5 | 17,16 | 22,97 |
| 0,45% P-4 + 0,10% H-5 | 12,02 | 20,37 |
| 0,55% P-5 | 4,46 | 16,44 |
| 0,55% H-5 | 17,16 | 22,97 |
| 0,45% P-5 + 0,10% H-5 | 14,10 | 23,23 |

It can be seen from this Table that when using stabilizer mixtures of 0.10% of component A and 0.45% of component B, the oxidation resistance of the oil is higher than would be expected from the data for the individual components.

EXAMPLE 7

The oxidation resistance is tested in a differential scanning calorimeter as in Example 6, except that the measurements are made under 8 bar of air with which 380 ppm of $(NO)_x$ have been mixed, rather than under oxygen, and the isothermal temperature is 170° C. Only the beginning of the exotherms is measured.

TABLE 7

| Stabilizer | $T_B$(min) |
|---|---|
| 0,55% P-2 | 11,2 |
| 0,55% H-5 | <2 |
| 0,45% P-2 + 0,10% H-5 | 20,7 |
| 0,55% P-6 | 3,8 |
| 0,55% H-5 | <2 |
| 0,45% P-6 + 0,10% H-5 | 10,8 |

P-6

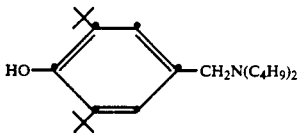

What is claimed is:

1. A lubricant composition comprising (A) a mineral or synthetic oil or a mixture of such oils, (B) at least one sterically hindered amine of formula III, IV or VIII

III

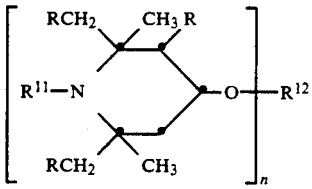

-continued

IV

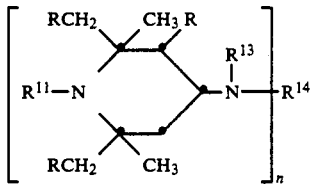

VIII

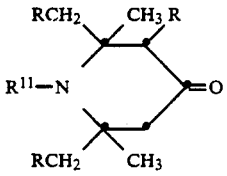

wherein

R is hydrogen, $R^{11}$ is hydrogen or methyl, n is 1 or 2, when n is 1, $R^{12}$ is $C_1$–$C_{18}$ alkyl, or when n is 2, $R^{12}$ is the diacyl radical of an aliphatic dicarboxylic acid having 4 to 12 C atoms, $R^{13}$ is hydrogen, $C_1$–$C_{12}$ alkyl or a group of the formula

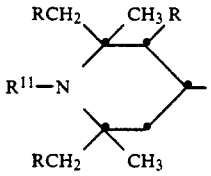

when n is 1, $R^{14}$ is hydrogen or $C_1$–$C_{12}$ alkyl, or when n is 2, $R^{14}$ is $C_2$–$C_8$ alkylene; and (C) at least one phenol of formula I

I

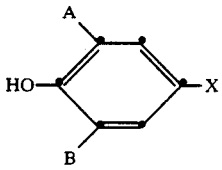

in which

A and B independently of the other are $C_1$–$C_4$ alkyl,

X is a group $—C_bH_{2b}—CO—OR^3$, b is 1 or 2, and $R^3$ is one of the groups

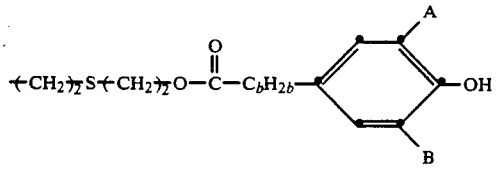

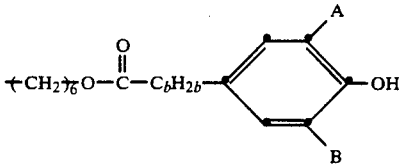

-continued and

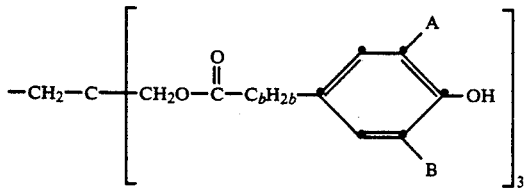

2. A composition according to claim 1, wherein the weight ratio of (B) to (C) is 1:1 to 1:100.

3. A composition according to claim 1, wherein the weight ratio of (B) to (C) is 1:3 to 1:20.

4. A composition according to claim 1, wherein the sum of (B) and (C) is 0.05 to 5% by weight of (A).

5. A composition according to claim 1, wherein (C) is a compound of formula I in which A and B independently of the other are $C_1$-$C_4$ alkyl, X is a group $-(CH_2)_2-CO-OR^3$ and $R^3$ is a group

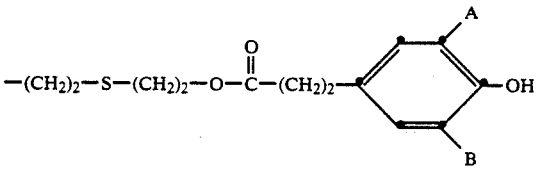

6. A composition according to claim 1 which is an engine oil.

7. A method for stabilizing a lubricant against oxidative degradation, which comprises incorporating into the lubricant a combination of components (B) and (C) as defined in claim 1.

8. A method according to claim 7 for reducing the formation of sludge in an engine oil.

9. A composition according to claim 1 wherein (B) is a compound of formula IX or X

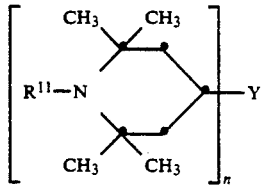

IX

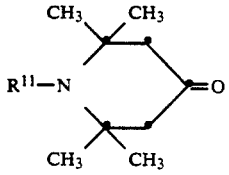

X in which $R^{11}$ is hydrogen or methyl, n is 1 or 2, when n is 1, Y is $-O(C_8-C_{15}$ alkyl), or when n is 2, Y is a group $-NH-(CH_2)_6-NH-$ or $-O-CO-(CH_2)_m-CO-O-$ in which m is 2-8, and (C) is defined as in claim 24.

10. A composition according to claim 9, wherein (B) is a compound of formula IX in which n is 2 and Y is a group $-NH-(CH_2)_6-NH-$ or $-O-CO-(CH_2)_8-CO-O$, and (C) is the compound of the formula

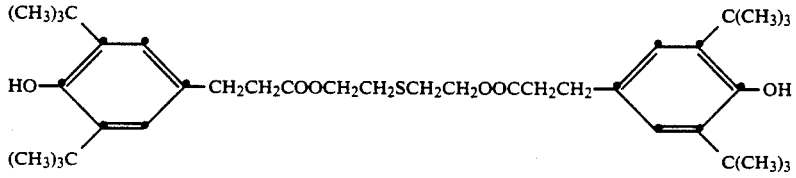

* * * * *